US005876906A

United States Patent [19]

Fyson et al.

[11] Patent Number: 5,876,906

[45] Date of Patent: Mar. 2, 1999

[54] METHOD OF PROCESSING PHOTOGRAPHIC SILVER HALIDE MATERIALS

[75] Inventors: John Richard Fyson, Hackney; Gareth Bryn Evans, Potten End, both of United Kingdom

[73] Assignee: Eastman Kodak Company, Rochester, N.Y.

[21] Appl. No.: 694,553

[22] Filed: Aug. 9, 1996

[30] Foreign Application Priority Data

Aug. 12, 1995 [GB] United Kingdom ..... 9516580

[51] Int. Cl.[6] ..... G03C 7/30

[52] U.S. Cl. ..... 430/393; 430/430; 430/455; 430/943

[58] Field of Search ..... 430/393, 430, 430/455, 943

[56] References Cited

U.S. PATENT DOCUMENTS

| | | | |
|---|---|---|---|
| 4,075,014 | 2/1978 | Gerhardt | 430/393 |
| 4,219,615 | 8/1980 | Sakai | 430/373 |
| 4,455,366 | 6/1984 | Hirano | 430/385 |
| 5,001,506 | 3/1991 | Nakamura | 354/324 |
| 5,387,499 | 2/1995 | Earle et al. | 430/943 |
| 5,445,925 | 8/1995 | Marsden et al. | 430/373 |
| 5,614,355 | 3/1997 | Haye et al. | 430/943 |
| 5,629,139 | 5/1997 | Twist | 430/943 |

FOREIGN PATENT DOCUMENTS

| | | |
|---|---|---|
| 0 620 488 A2 | 10/1994 | European Pat. Off. . |
| 1 530 933 | 6/1975 | United Kingdom . |
| 91/12567 | 2/1990 | WIPO . |

*Primary Examiner*—Hoa Van Le
*Attorney, Agent, or Firm*—J. Lanny Tucker

[57] ABSTRACT

High silver chloride photographic materials can be processed with a process comprising two fixing steps, one before and another after a hydrogen peroxide bleaching step. The first fixing step utilizes a sulfite fixing agent.

16 Claims, 6 Drawing Sheets

METHOD OF PROCESSING PHOTOGRAPHIC SILVER HALIDE MATERIALS

FIELD OF THE INVENTION

This invention relates to the processing of color materials comprising an emulsion comprising at least 85 mole % silver chloride. The materials are intended for conventional processing and contain relatively high silver coverage levels.

BACKGROUND OF THE INVENTION

In the field of low silver coverage photographic materials intended for redox amplification (RX) processes it has been proposed to use a fixer comprising an alkali metal sulfite as fixing agent and a bleach comprising a peroxide and an alkali metal halide. These proposals are described in European Publications. 0,540,619, 0,506,909, and 0,470,083.

Such fixers and bleaches are more environmentally friendly than thiosulfate fixers or bleaches containing ferricyanide ions or complexes of iron as the bleaching agent.

The silver level, however, in conventionally processed materials is much higher than those used with RX processes hence process times are expected to be longer when they are applied to conventional materials. For example if there is more silver halide to remove, more time will be taken for the fixing step.

The silver from the image can be removed by a conventional bleach-fix but this contains iron(III) EDTA that is considered a problem in the environment when sewered.

A peroxide bleach immediately following the developer results in increased density caused by continued redox amplification that may result in staining. It is also difficult to maintain the desired sensitometry in such circumstances. This problem can be alleviated by incorporating an acid stop or wash bath after image formation.

When the silver level is higher than those used with the lowest silver RX materials it has been found that when they are processed through a process consisting of developer, sulfite fixer, peroxide rehalogenating bleach then wash, the silver chloride will print-up slowly in image areas and is very sensitive to darkening caused by sulfide in the atmosphere.

The problem is therefore to use a sulfite fixer and a peroxide rehalogenating bleach on color silver halide materials while retaining full bleaching and fixing without suffering from variations in the sensitometric keeping properties.

SUMMARY OF THE INVENTION

According to the present invention there is provided a method of processing an imagewise exposed photographic silver halide material comprising at least two dye image-forming layer units responsive to two different regions of the spectrum, and a silver halide emulsion comprising at least 85% silver chloride, and the layer units each containing a dye image-forming color coupler, the method comprising, in sequence:

A) forming a dye image in the material,

B) fixing the material in a fixing solution containing an alkali metal sulfite or a material that provides sulfite, as fixing agent, C) bleaching the material with a bleaching solution containing hydrogen peroxide or a material that provides hydrogen peroxide, as a bleaching agent, and an alkali metal halide, D) fixing the material, and E) washing the material.

The use of bleach fix baths containing a bleaching agent of the ferric EDTA type is avoided with this invention.

The effects of carried-over sulfite in the bleach bath are eliminated because such sulfite will be destroyed by the peroxide present in the bleach.

Silver is precipitated in the fix making silver recovery easier than usual.

DETAILED DESCRIPTION OF THE INVENTION

Figure 1:
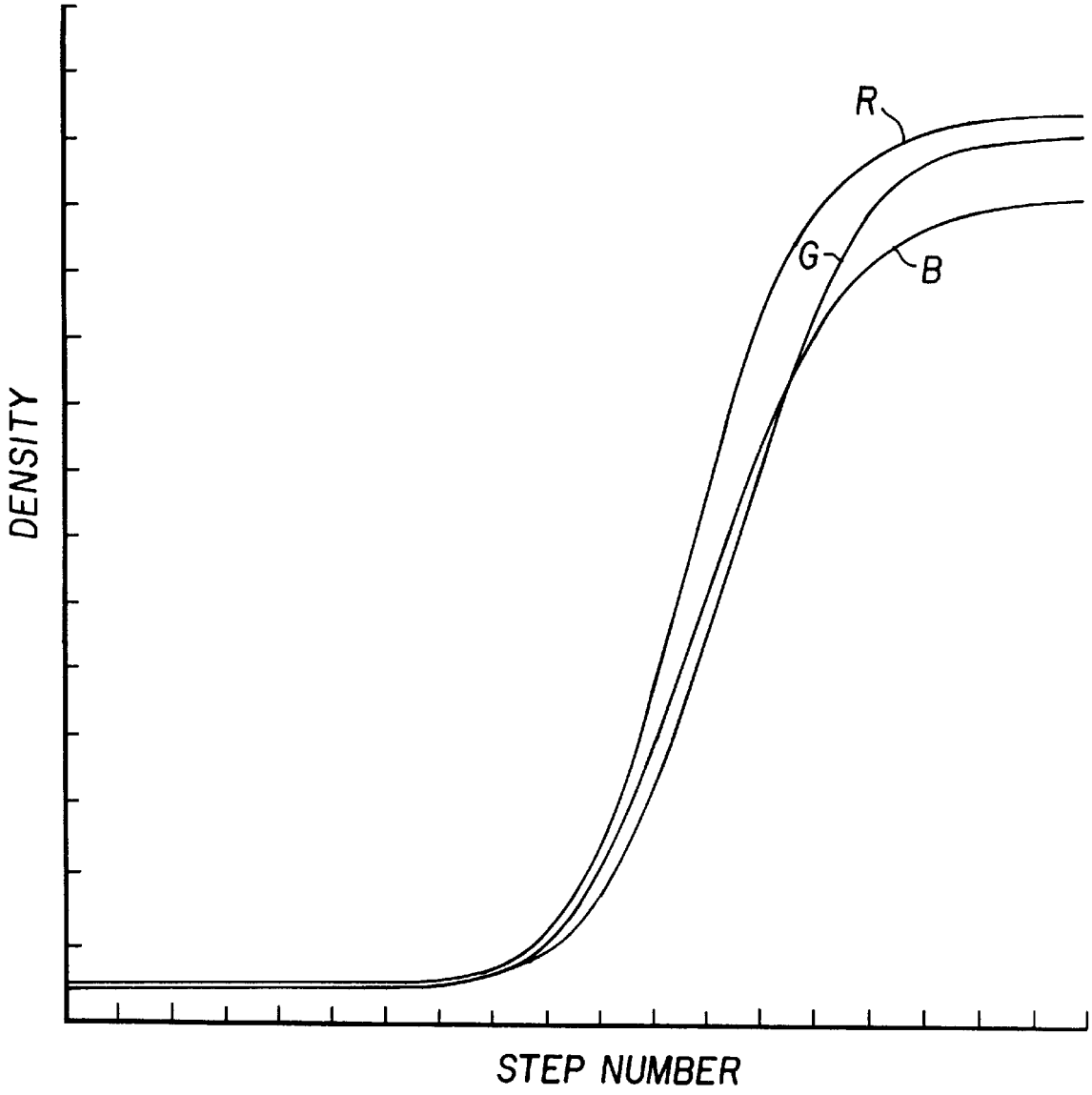
Figure 2:
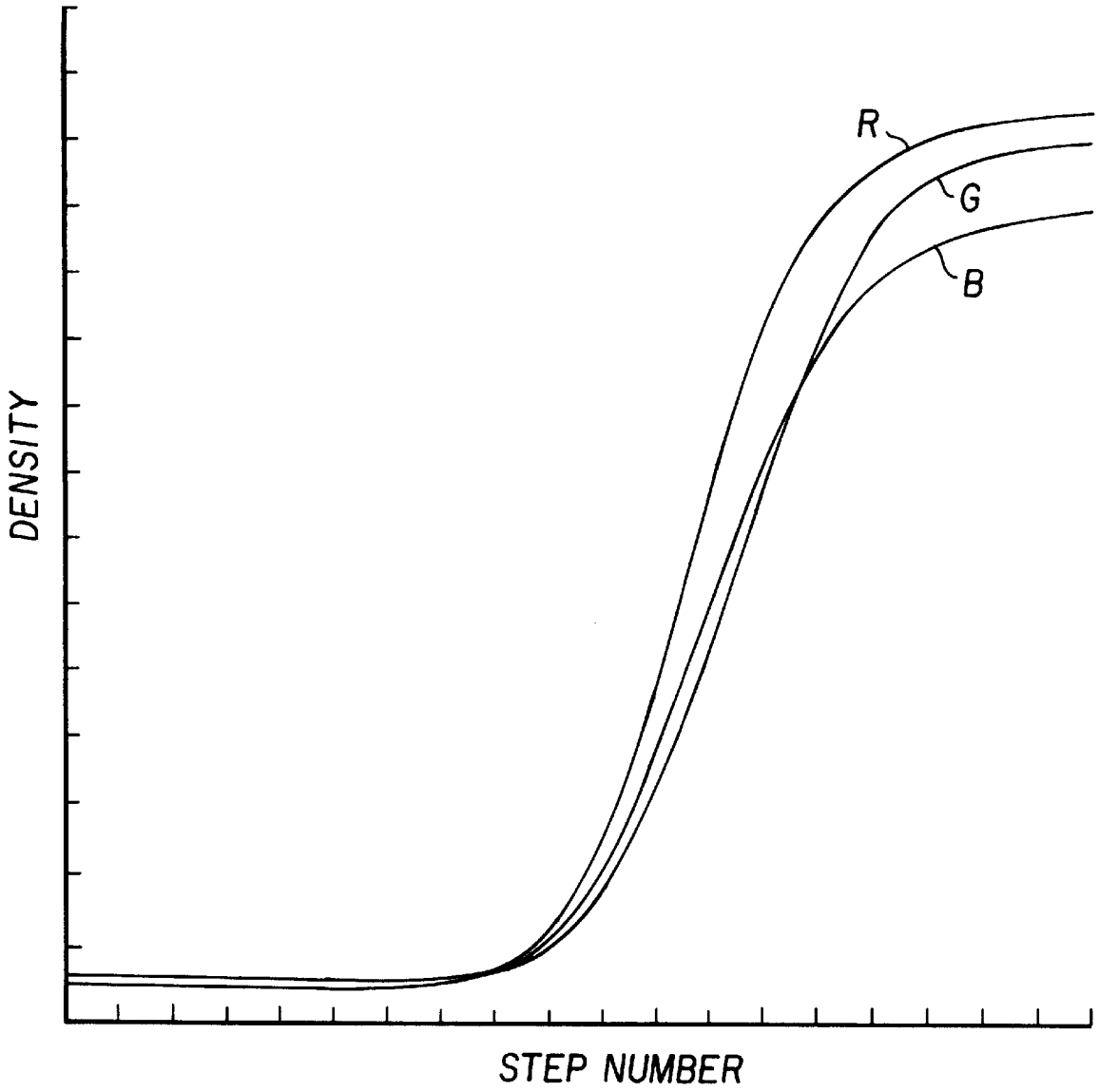
Figure 3:
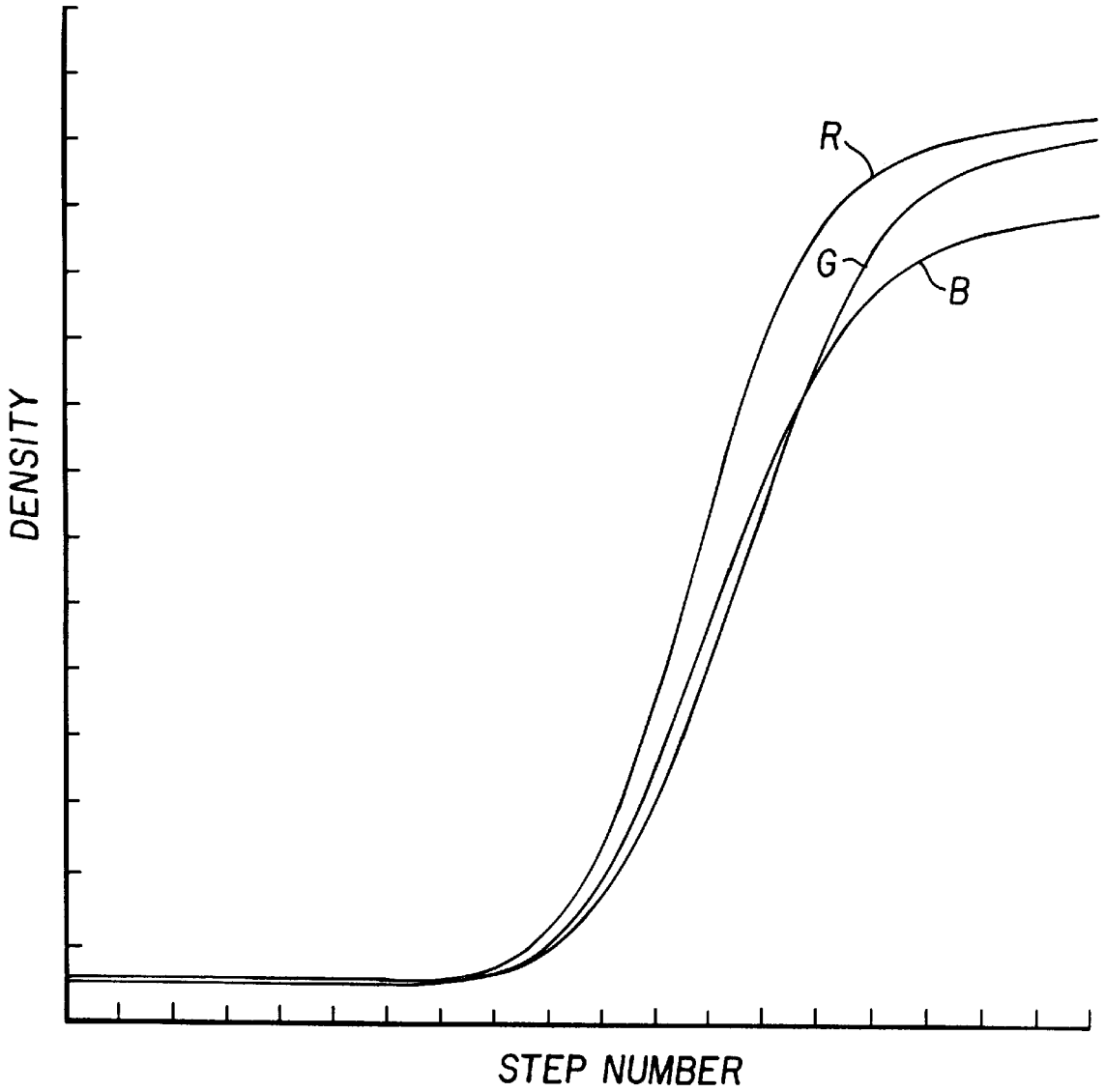
Figure 4:
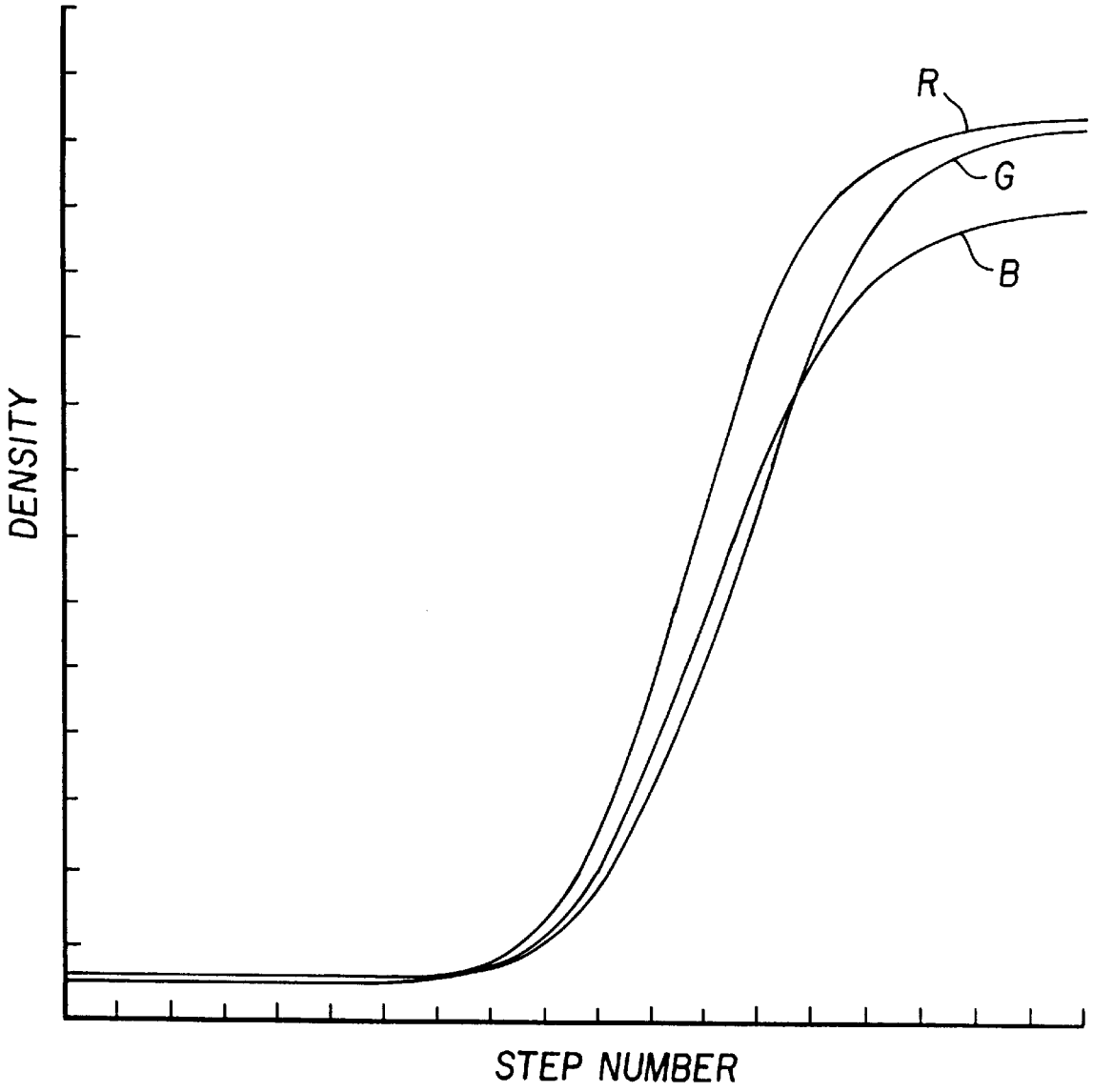

The dye image-forming step may be a conventional color development step and/or a redox amplification step.

A particular application of this technology is in the processing of silver chloride color paper, for example paper comprising an emulsion having at least 85 mole percent silver chloride, especially such paper with silver levels, of from 20 to 2000 mg/m$^2$, preferably in the range 50 to 700 mg/m$^2$.

The sulfite fixer may contain from 20 to 150 g/l of the alkali metal sulfite (as sodium sulfite) Corresponding levels of materials that provide sulfite during processing, e.g., an alkali metal metabisulfite can also be used. The fixer may have a pH above 6.4, preferably in the range 6.5 to 9, especially 7.0. A buffering material may be used, for example an alkali metal acetate in order to maintain the desired pH.

The bleaching agent is hydrogen peroxide or a material that provides hydrogen peroxide, e.g., a persulfate. The bleach bath may contain 10 to 200 g/l, preferably 30 to 100 g/l of 30% w/w hydrogen peroxide solution. The bleach bath may also contain 0.5 to 30 g/l of alkali metal halide (as sodium chloride)

The bleach may also contain metal-chelating agents to avoid them catalyzing the hydrogen peroxide. Such compounds may be 1-hydroxyethylidene-1,1'-diphosphonic acid or diethyltriaminepentaacetic acid type.

The bleach preferably has a pH in the range 8 to 11 and is preferably about 10. It may contain a buffer, for example an alkali metal carbonate.

The photographic elements can be single color elements or multicolor elements having a paper or film base. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Suitable materials for use in this invention, can have any of the components described in *Research Disclosure*, Item 36544, September 1994, published by Kenneth Mason Publications, Emsworth, Hants P010 7DQ, United Kingdom.

The present processing solutions are preferably used in a method of processing carried out by passing the material to be processed through a tank containing any of the processing solution that is recirculated through the tank at a rate of from 0.1 to 10 tank volumes per minute. The preferred recirculation rate is from 0.5 to 8, especially from 1 to 5 and particularly from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length x width of material) is less than 11 $dm^3/m^2$, preferably less than 3 $dm^3/m^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that delivers the processing solution to the processing channel have a configuration in accordance with the following relationship:

$$0.6 \leqq F/A \leqq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following patent specifications: U.S. Pat. No. 5,294,956, U.S. Pat. No. 5,179,404, U.S. Pat. No. 5,270,762, EP-A-559,025, EP-A-559,026, EP-A-559,027, WO 92/10790, WO 92/17819, WO 93/04404, WO 92/17370, WO 91/19226, WO 91/12567, WO 92/07302, WO 93/00612, WO 92/07301, WO 92/09932 and U.S. Pat. No. 5,436,118.

The following Examples are included for a better understanding of the invention.

EXAMPLE 1

The photographic material used in this invention was a conventional color paper, KODAK™ 'Supra', containing a pyrazolone magenta coupler, with a total silver laydown of about 650 $mg/m^2$. The silver halide is essentially all silver chloride but with about 3% bromide. This material was exposed in a sensitometer at 1/10s through a 0.15 log wedge with correction filters added to try to get a neutral gray scale. The wedge also includes red, green and blue separations.

The following solutions were made up to be used in the processes that follow:

| | |
|---|---|
| Developer | |
| 1-hydroxyethylidene-1,1'-diphosphonic acid | 0.6 g |
| diethyltriaminepentaacetic acid | 2.0 g |
| Triethanolamine | 5.5 ml |
| Diethylhydroxylamine | 5 ml |
| PHORWITE REU | 1 g |
| Potassium chloride | 6.4 g |
| Potassium carbonate | 25 g |
| 4-N-ethyl-N-(β-methanesulfonamidoethyl)-o-toluidine sesquisulfate | 4.5 g |
| Water to | 1 liter |
| pH adjusted to 10.3 with sodium hydroxide | |
| Sulfite Fixer | |
| Sodium sulfite (anhydrous) | 100.0 g |
| Sodium acetate | 40.0 g |
| Water to | 1 liter |
| pH adjusted to 7.0 with sulfuric acid | |
| Accelerated Sulfite Fixer | |
| Sodium sulfite (anhydrous) | 100.0 g |
| Sodium acetate | 40.0 g |
| 1,2 diaminoethane | 10 ml |
| Water to | 1 liter |
| pH adjusted to 7.0 with sulfuric acid | |
| Rehalogenating peroxide bleach 1 | |
| 1-hydroxyethylidene-1,1'-diphosphonic acid | 0.6 g |
| diethyltriaminepentaacetic acid | 2.0 g |
| Sodium chloride | 1.0 g |
| Sodium hydrogen carbonate | 20.0 g |
| Hydrogen peroxide (30% w/w) | 50.0 g |
| Water to | 1 liter |
| pH adjusted to 10.0 with sodium hydroxide or sulfuric acid | |
| Rehalogenating peroxide bleach 2 | |
| 1-hydroxyethylidene-1,1'-diphosphonic acid | 1.0 g |
| Sodium chloride | 20.0 g |
| Sodium hydrogen carbonate | 3.0 g |
| Sodium carbonate | 4.0 g |
| Hydrogen peroxide (30% w/w) | 50.0 g |
| Water to | 1 liter |
| pH adjusted to 10.0 with sodium hydroxide or sulfuric acid | |
| Bleach-fix | |
| Ammonium iron (III) EDTA solution (1.56M) | 100 ml |
| Ammonium thiosulfate | 100 g |
| Sodium sulfite | 20 g |
| Acetic acid (glacial) | 15 ml |
| Water to | 1 liter |
| pH adjusted to 6.0 | |

The following is a list of process used to test the invention. All were carried out at 35° C. It is indicated for each process whether it is a comparison or an example of the invention.

| | |
|---|---|
| Process 1 (comparison) | |
| Developer | 45 sec |
| Bleach-fix | 45 sec |
| Wash | 60 sec |
| Dry | |
| Process 2 (invention) | |
| Developer | 45 sec |
| Sulfite fixer | 90 sec |
| Peroxide bleach 1 | 90 sec |
| Sulfite fixer | 90 sec |
| Wash | 60 sec |
| Dry | |
| Process 3 (invention) | |
| Developer | 45 sec |
| Sulfite fixer | 90 sec |
| Peroxide bleach 2 | 90 sec |
| Sulfite fixer | 90 sec |
| Wash | 60 sec |
| Dry | |
| Process 4 (invention) | |
| Developer | 45 sec |
| Accelerated sulfite fixer | 60 sec |
| Peroxide bleach 2 | 90 sec |
| Accelerated sulfite fixer | 60 sec |
| Wash | 60 sec |
| Dry | |

After processing, the strips were measured using a Status A densitometer. The results are shown as FIGS. 1, 2, 3 and 4. It can be seen that all the processes have similar sensitometry showing that good sensitometry, equaling the prior bleach-fix process, can be achieved using a fix, peroxide bleach, fix tailend of the present invention with or without an accelerator (diaminoethane) in the fixer and with two levels of chloride in the bleach.

A strip of the same paper was also processed through Process 2 but omitting the second fixer (comparative) and therefore silver halide was retained in the image areas. The three colors of a yellow Dmax strip were measured and compared to the results obtained after hanging the same strip in a south facing window for two days. The red and green densities in this yellow patch increased by 0.05 showing that the silver halide would still print up and the second fixer bath was necessary to prevent this.

EXAMPLE 2

Figure 5:
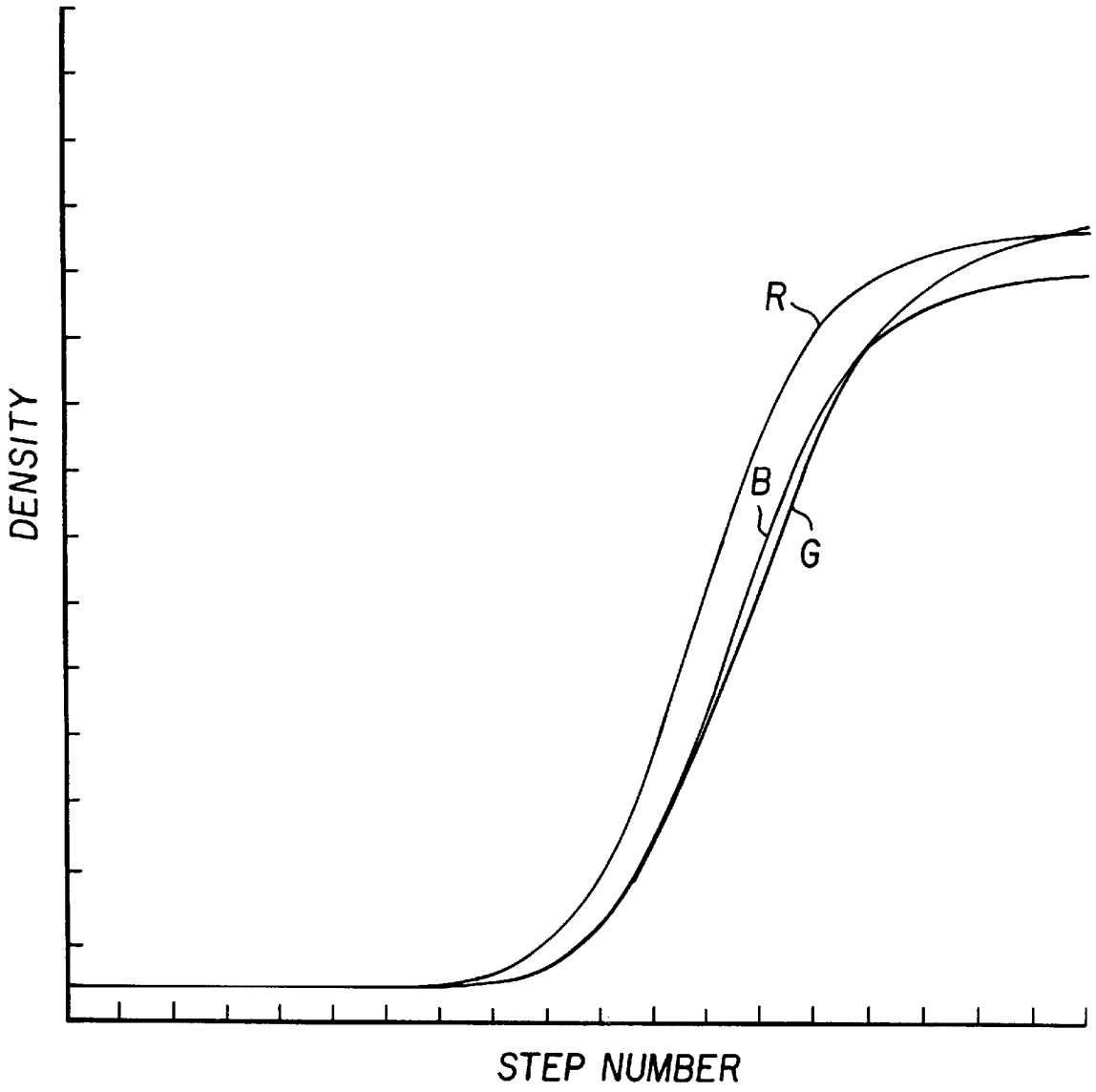
Figure 6:
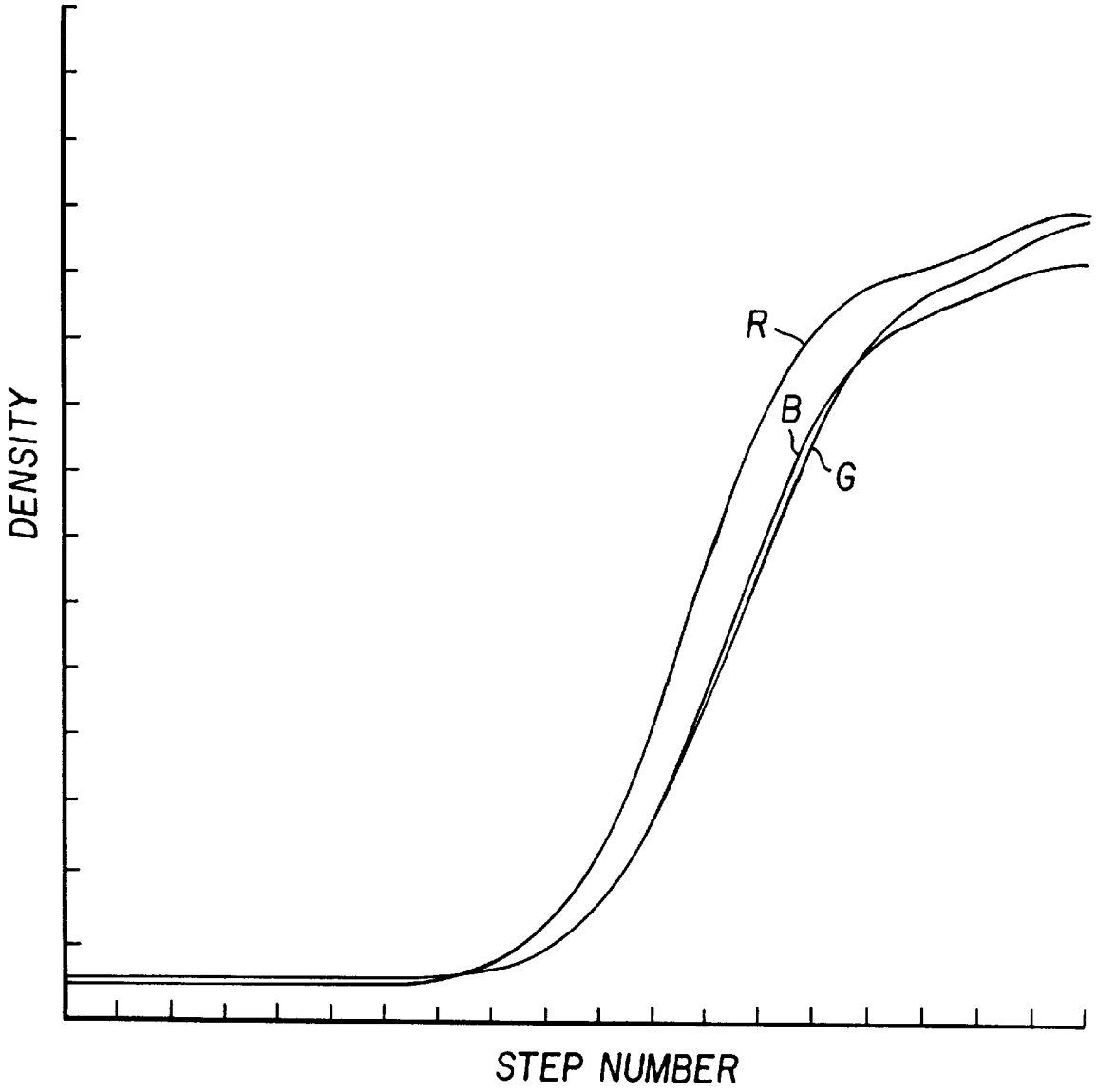

Process 1 and Process 2 of Example 1 were repeated using the same solutions but with a paper containing a pyrazolotriazole magenta coupler (Fuji SFA-3 paper). The sensitometry is shown in FIGS. 5 and 6. The curves are almost identical showing that the more fix, peroxide bleach, fix process of the present invention can be substituted for the standard process with a bleach-fix for papers containing pyrazolotriazole couplers.

The invention has been described in detail with particular reference to preferred embodiments thereof, but it will be understood that variations and modifications can be effected within the spirit and scope of the invention.

We claim:

1. A method of processing an imagewise exposed photographic silver halide color paper comprising at least two dye image-forming layer units responsive to two different regions of the spectrum, and a silver halide emulsion comprising at least 85% silver chloride, and said layer units each containing a dye image-forming color coupler, said method comprising a single dye image forming step, and having the steps, in sequence:

A) forming a dye image in said color paper,

B) fixing said color paper in a fixing solution having a pH of from 6.5 to 9, and containing an alkali metal sulfite or a material that provides a sulfite, as fixing agent, present in an amount of from 20 to 150 g/l, C) bleaching said color paper with a bleaching solution containing hydrogen peroxide or a material that provides hydrogen peroxide, as a bleaching agent, in an amount of from 10 to 200 g/l when provided as a 30% (w/w) hydrogen peroxide solution, and an alkali metal halide present in an amount of from 0.5 to 30 g/l, D) fixing said color paper, and E) washing said color paper.

2. The method of claim 1 wherein said dye image-forming step is a color development or redox amplification step.

3. The method of claim 1 wherein fixing step D is carried out with a fixing solution containing an alkali metal or ammonium thiosulfate as fixing agent.

4. The method of claim 1 wherein the fixing solutions used in said fixing steps are replenished separately.

5. The method of claim 4 wherein either (a) the replenisher used in fixing step D comprises the overflow from the fixer of another processing line, or (b) the overflow from fixing step D is used to replenish the fixer from another processing line.

6. The method of claim 5 wherein said other processing line is used for processing a color negative film.

7. The method of claim 1 wherein the fixing solution used in step D contains an alkali metal sulfite as the fixing agent.

8. The method of claim 7 wherein the fixing solution used in said fixing steps are replenished using the same replenisher solution, or the overflow from one solution comprises the replenisher for the other.

9. The method of claim 1 wherein the total silver halide coating weight in said color paper is from 20 to 2000 $mg/m^2$ as silver.

10. The method of claim 9 wherein the total silver halide coating weight in said color paper is from 50 to 700 $mg/m^2$.

11. The method of claim 1 carried out by passing said color paper through a tank containing a processing solution that is recirculated through said tank at a rate of from 0.1 to 10 tank volumes per minute.

12. The method of claim 11 carried out by passing said color paper through a tank containing a processing solution that is recirculated through said tank at a rate of from 2 to 4 tank volumes per minute.

13. The method of claim 1 carried out in a machine wherein the ratio of tank volume to maximum area of color paper accommodatable therein is less than 11 $dm^3/m^2$.

14. The method of claim 13 wherein the ratio of tank volume to maximum area of color paper accommodatable therein is less than 3 $dm^3/m^2$.

15. The method of claim 1 wherein said photographic silver halide color paper contains a pyrazolone magenta dye forming coupler, and has a silver laydown of from 50 to 700 $mg/m^2$.

16. The method of claim 1 having a single color development step as said dye image forming step.

* * * * *